United States Patent [19]

Skyba

[11] Patent Number: 4,669,575

[45] Date of Patent: Jun. 2, 1987

[54] TREE STEP

[76] Inventor: Helmut K. Skyba, Rte. 2, Box 330, Wild Rose, Wis. 54984

[21] Appl. No.: 923,288

[22] Filed: Oct. 27, 1986

[51] Int. Cl.[4] ..... A63B 27/00

[52] U.S. Cl. ..... 182/92; 248/217.4

[58] Field of Search ..... 182/92, 91, 90; 248/217.4

[56] References Cited

U.S. PATENT DOCUMENTS

| | | | |
|---|---|---|---|
| 543,121 | 7/1895 | Bates | 248/217.4 |
| 907,483 | 12/1908 | Ette . | |
| 1,437,864 | 12/1922 | Rupe et al. . | |
| 1,588,566 | 6/1926 | Wismer . | |
| 1,740,873 | 12/1929 | Peirce, Jr. . | |
| 3,298,459 | 1/1967 | Bergsten . | |
| 3,380,697 | 4/1968 | Melcher . | |
| 3,498,409 | 3/1970 | Meyer . | |
| 3,729,160 | 4/1973 | D'Imperio . | |
| 4,413,706 | 11/1983 | Michael . | |
| 4,415,061 | 11/1983 | Meyer . | |
| 4,449,612 | 5/1984 | Southard . | |

*Primary Examiner*—Reinaldo P. Machado

*Attorney, Agent, or Firm*—Fuller, Puerner & Hohenfeldt

[57] ABSTRACT

A tree step aids persons to climb trees. The tree step comprises a handle and an arm that pivot between a closed side-by-side configuration and an open configuration of 90°. The handle defines a rectangular opening for accepting the head of a lag screw. A concave recess in the opening proximate the handle free end is engageable with the screw shank. After a lag screw is driven into the tree, the handle opening is passed over the screw head and pulled downwardly so that the opening recess engages the screw shank. A leaf spring fastened to the handle has a U-shaped portion that captures the lag screw head when the screw shank is engaged in the concave recess to thereby prevent upward movement of the handle relative to the screw. The screw may be started into the tree by placing the screw to extend longitudinally from the handle with the screw head inserted in the opening and retained therein by the leaf spring. In that mode, the tree step acts as a screwdriver for starting the screw.

17 Claims, 7 Drawing Figures

TREE STEP

BACKGROUND OF THE INVENTION

1. Field of the Invention

This invention pertains to climbing equipment, and more particularly to apparatus for assisting outdoorsmen to climb trees.

2. Description of the Prior Art

A favorite observation post for many hunters, especially deer hunters, is in a tree. From a tree stand, the hunter has an excellent vantage point for viewing game in the vicinity.

However, the hunter faces the problem of climbing the tree to reach his tree stand. Climbing a large tree while carrying hunting gear is frequently very difficult. A solution to the climbing problem is to saw off the lower branches and to make a sort of ladder by nailing short pieces of wood to the tree trunk in a vertical arrangement. That solution is not satisfactory for several reasons. It requires the inconvenience of carrying hammer, nails, and wood pieces to the site. The ladder is a temptation to unattended and inexperienced persons to climb the tree and risk injury.

Another solution is to saw the lower limbs of the tree, leaving short stubs to serve as hand and foot holds. Unfortunately, a tree having limbs suitably placed for climbing is seldom found at the hunter's preferred location.

Recognizing the deficiencies of the foregoing solutions, hunters have developed a variety of mechanical tree steps to help them climb trees. The tree steps disclosed in U.S. Pat. Nos. 907,483; 3,298,459; 3,380,697; 3,498,409; 3,729,160; 4,413,706; 4,415,061; and 4,449,612 include screws or screw-like components that are turned into the tree trunk. In some of the foregoing patents, the screw forms an integral part of the tree step. In other of the patents, the screws are separate pieces. However, in every device, the step portion cannot be removed from the tree unless the screw or screw-like component is turned out of the tree. Consequently, the entire device must be removed from the tree after each day's hunt if the hunter does not want to leave the tree step in the tree overnight. The following morning, he is faced with the task of returning all the tree steps into the tree prior to climbing. Repeatedly turning a screw member into and out of a tree is injurious to it and tends to wear the threads formed in the tree, thereby imperiling the climber's safety. Further, it is a difficult task to set up the various prior tree steps in pre-dawn darkness, especially in a quiet manner so as not to disturb nearby game. Since the tree steps of the aforementioned patents are more or less permanently mounted to a tree, the hunter must purchase a quantity sufficient for all the trees he normally uses as observation posts during the hunting season. The requirement of buying tree steps for more than one tree is a financial burden.

U.S. Pat. Nos. 1,437,864; 1,588,566; and 1,740,873 show pole steps in which screws are permanently inserted into poles. The steps are designed to be hooked over and removed from the pre-inserted screws. However, the screws of the foregoing three patents require a separate wrench or similar tool for turning the screws into the pole. Carrying an extra tool into the woods is inconvenient for hunters.

Thus, a need exists for inexpensive and convenient means for assisting hunters to climb virtually any tree.

SUMMARY OF THE INVENTION

In accordance with the present invention, a sturdy and possible tree step is provided that permits a person to quickly and easily climb the trunks of suitably large trees. This is accomplished by apparatus that includes a pivotally connected handle and arm that are removeably securable to the tree by a lag screw.

In the folded configuration, the arm nests within the handle in a compact and easy to carry manner. The handle and arm are foldable to form a case for loosely capturing the screw. Upon unfolding the arm and handle, the screw is exposed for removal. The free end of the handle is formed with a transverse rectangular opening therethrough having a size and shape to accept the screw head. The opening also defines a concave recess proximate the handle free end. The recess has a radius approximately equal to the radius of the screw shank. Consequently, the screw head can be passed through the opening in a direction perpendicular to the plane of the opening, and the screw shank can engage the opening concave recess when the head is outside the opening.

Near the pivot end of the handle is secured a leaf spring. The free end of the leaf spring is bent into a generally U-shape sized to fit over the screw head. The U-shape portion is located generally over the handle rectangular opening such that a leg of the U-shaped portion holds the screw in engagement with the concave recess.

The tree step of the present invention is carried by the hunter or other person in the folded configuration. Upon reaching a tree the person wishes to climb, he unfolds the tree step and removes the lag screw. The leaf spring is pulled back, and the lag screw head is slid along the handle, with the screw axis parallel to the plane of the opening, until the screw head enters the rectangular opening. The leaf spring is relaxed to spring back and retain the screw head within the opening, so that the screw extends longitudinally from the handle free end. The arm is then closed. The hunter is then able to grasp the folded tree step and force or drive the screw point into the tree trunk and simultaneously turn the screw a few turns. The U-shaped leaf spring retains the screw in place against the axial force of jamming the screw into the tree. After the screw has been started, the arm is opened to a right angle with respect to the handle. The leaf spring is pulled away from the head, and the handle is slid off the head. The handle is next manipulated such that the rectangular opening is passed over the screw head to receive the head in the opening, with the screw axis perpendicular to the plane of the opening. The arm is then rotated about the screw axis, causing the handle to act as a lever for easily turning the screw almost completely into the tree. At that point, the handle is pushed against the tree, and the opening passes beyond the screw head, thereby deflecting the leaf spring. The handle is rotated to a vertical attitude and pulled downwardly, so that the screw shank engages the opening concave recess. The leaf spring then springs back to capture the head and prevent the handle from moving upward and disengaging the handle from the screw shank unless the spring is intentionally deflected away from the screw head. The result is that the screw is turned into the tree without the use of additional tools. The handle and arm are securely held in place on the tree by the screw, and the horizontal arm forms a sturdy foot step.

The tree step can easily be removed from the tree merely by pulling the leaf spring away from the screw head, pushing the tree step upwardly until the screw shank is disengaged from the concave recess, and pulling the handle opening horizontally over the screw head. The tree step can then be folded for safe and easy carrying, while the screw remains in the tree, ready for reuse at a later time.

Other objects and advantages of the invention will become apparent to those skilled in the art upon reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
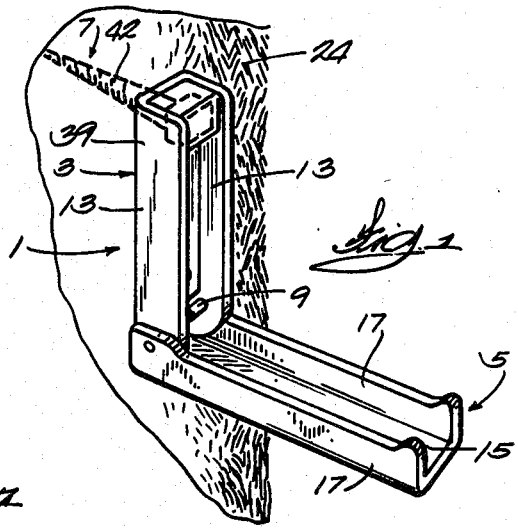
FIG. 1 is a perspective view of the present invention shown in the open configuration for use on a tree.

Referring to FIG. 1, a tree step 1 is illustrated that includes the present invention. The tree step is particularly useful to hunters for climbing to their tree stands, but it will be understood that the invention is not limited to hunting related activities.

Figure 4:
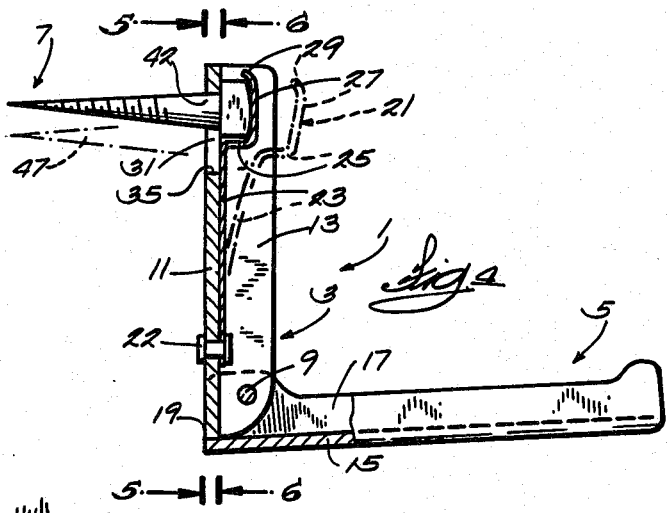
FIG. 4 is a side view, partially in section of the tree step in the open configuration in place on a tree.

The tree step 1 comprises a handle 3, an arm 5, and a lag screw 7. The handle 3 and arm 5 are pivotally connected by a pin 9 or other suitable means for rotating between an open configuration as shown in FIGS. 1 and 4, and a closed or folded configuration, FIGS. 2 and 3.

As best shown in FIG. 1, the handle 3 is preferably shaped as a U-shaped channel having a base 11 and sides 13. The arm 5 is also preferably fabricated as a U-shaped channel having a base 15 and sides 17. See FIGS. 5 and 6. In the closed configuration of FIGS. 2 and 3, the handle and arm channels cooperate to form a 4-sided, open ended structure. In the open configuration of FIGS. 1 and 4, the angle between the handle and arm is limited to approximately 90° by contact between the channel bases 11 and 15 at point 19.

The handle 3 includes a leaf spring 21 that is fastened near the handle pivot end by a rivet 22 or similar fastener. The leaf spring is biased to the position shown by the outline 23 in FIGS. 2 and 4. The free end of the leaf spring 21 is bent into a generally U-shaped contour having an upright leg 25, a longitudinal leg portion 27 and a short return leg 29.

Figure 5:
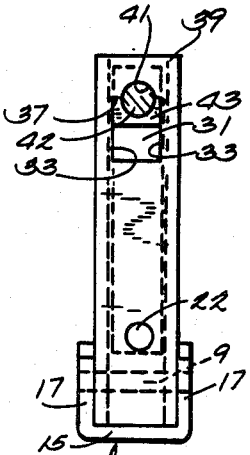
FIG. 5 is a cross-sectional view taken along lines 5—5 of FIG. 4.
Figure 6:
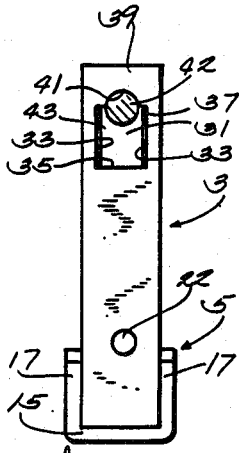
FIG. 6 is a cross-sectional view taken along lines 6—6 of FIG. 4.

As best shown in FIGS. 5 and 6, the free end 39 of the handle 3 is manufactured with an opening 31 therethrough. In the preferred embodiment, the opening 31 has opposed longitudinal sides 33, a first transverse side 35, and a second transverse side 37 that define a square or rectangle. The transverse side 37, which is proximate the handle free end 39, is formed with a concave recess 41. The recess 41 has a radius slightly larger than the radius of the screw shank portion 42. The distance between the sides 33 is slightly greater than the width of the flats of the head 43 of the screw 7. The distance between the opening sides 35 and 37 is at least as great, but may be greater than, the distance between the sides 33.

Figure 3:
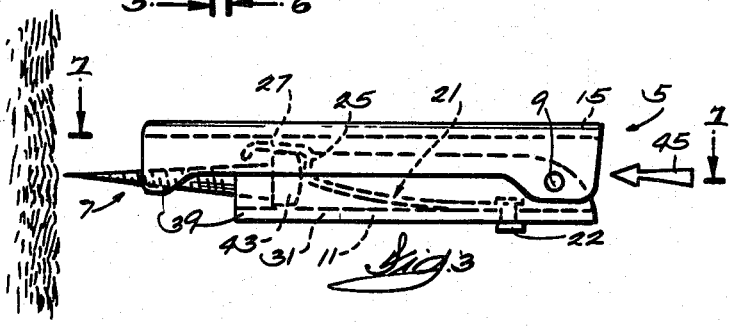
FIG. 3 is a side view of the tree step showing it in the closed configuration and in a position for forcing a screw into a tree.
Figure 2:
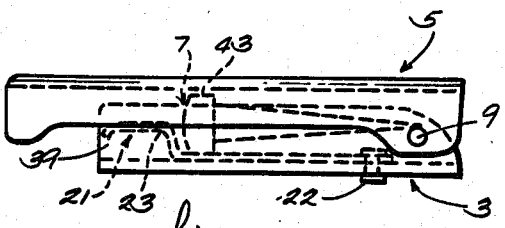
FIG. 2 is a side view of the tree step showing it in the closed configuration.

In the closed configuration of FIGS. 2 and 3, the screw 7 is enclosable within the channels comprising the handle 3 and arm 5. The screw is retained lengthwise within the handle and arm by the U-shaped portion of the leaf spring 21 and by the pin 9. That design enables a hunter to carry the tree step 1 of the present invention in a minimum of space and without requiring a separate container for the screw.

Figure 7:
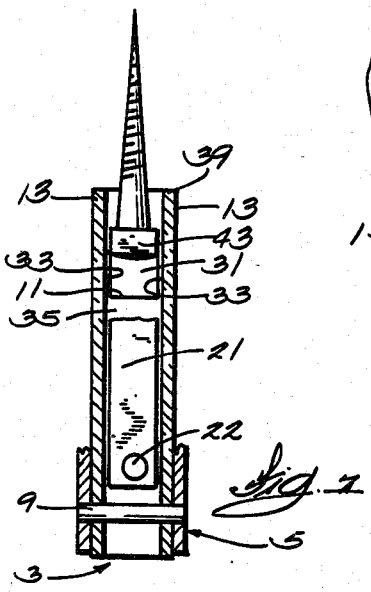
FIG. 7 is a partial cross-sectional view taken along lines 7—7 of FIG. 3.

To use the tree step 1 of the present invention upon reaching a selected tree 24, the hunter opens the arm 5 and handle 3 to expose the screw 7. The screw is removed from the channels. The leaf spring 21 is pulled back from the normal biased position 23 of FIGS. 2 and 4. Referring especially to FIGS. 3 and 7, the screw is slid head first longitudinally along the inside surface of the handle channel base 11 until the head 43 can be inserted in the rectangular opening 31 as shown in FIG. 3. At that point, the screw axis is parallel to the plane of the opening. Opposite faces of the head 43 are guided between opposed longitudinal sides 33. The threads of the screw are guided on the inside surface of the channel base and extend longitudinally past the handle free end 39. The leaf spring is released to retain the head in the opening. The arm is pivoted to the closed configuration of FIG. 3. The hunter then uses the folded tree step as a handle and jams or drives the screw in the tree. The handle can then be used as a sort of screwdriver, pushing the screw point into the tree, as is indicated by arrow 45, and simultaneously rotating the tree step and retained screw about the screw axis to start the screw threads into the tree. The opening sides 33 contact opposite screw head flats for turning the screw with the folded tree step, and the leaf spring leg 25 holds the screw in place axially within the folded tree step against the force 45.

After the screw 7 has been started, the hunter opens the arm 5, pulls back the leaf spring 21, disengages the opening 31 from the screw head 43, and removes the tree step 1 from the screw, which remains in the tree 24. The handle 3 is then rotated 90°, and the opening 31 is placed over the screw head with the screw axis perpendicular to the plane of the opening as shown in FIGS. 1 and 4. The four opening sides 33, 35, and 37 receive the head. At that point, the screw has a position relative to the handle as shown by the phantom lines 47 of FIG. 4. The leaf spring is deflected only slightly under that condition. The hunter then grasps the arm 5 and uses it as a hand hold to turn the handle and screw. With the handle acting as a lever, the screw is easily screwed into the tree trunk. As shown in FIG. 4, the screw is turned until a clearance slightly greater than the thickness of the handle channel base 11 remains between the tree and the screw head. At that point, the handle is pushed against the tree trunk such that the screw head passes completely through the opening 31. That action causes the head to contact the leaf spring at the base of leg 25 and deflect it to the position generally indicated by phantom lines 21 of FIG. 4. The handle is rotated to a vertical position and pulled downwardly so that the recess 41 engages the screw shank 42. Engaging the screw shank with the recess 41 causes the screw head to slide into the U-shaped portion of the leaf spring, so that the leaf spring snaps back to the undeflected position indicated by the lines of reference numeral 23. The screw is then in a position relative to the handle as indicated by the solid lines 7 of FIG. 4. The leaf spring leg 25 abuts the bottom flat of the screw head to prevent the handle from moving upwardly relative to the screw until the leaf spring is manually pulled back away from the undeflected position 23. Consequently, the screw is turned into the tree without the use of a tool other than the tree step itself. The tree step is securely mounted to the tree for carrying the weight of the hunter and to assist him climb the tree.

When it is desired to remove the tree step 1 from the tree 24, the leaf spring 21 is pulled back away from the screw head 43. The handle 3 is pushed upwardly to disengage the screw shank 42 from the recess 41. The handle is pulled back away from the tree such that the handle opening 31 passes completely over the screw head. The tree step is then folded for convenient carrying. The screw 7 may be left in the tree when it is ready to support the tree step the next time the hunter wants to climb the tree. Alternately, the screw may be removed by placing the opening 31 over the head and rotating the arm and handle about the screw axis to turn the screw out of the tree.

Thus, it is apparent that there has been provided, in accordance with the invention, a tree step that fully satisfies the objects and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A tree step comprising:

a. a screw having a head and a shank portion;

b. an arm;

c. a handle having a first end pivotally connected to the arm and a free end, the free end being formed with an opening therethrough adapted to receive and engage the screw; and d. spring means fastened to the handle for biasing the screw into engagement with the handle.

2. The tree step of claim 1 wherein:

a. the screw has a rectangular head and a shank portion;

b. the handle opening is generally rectangular to receive the screw head and to permit the screw head to pass bi-directionally through the opening; and c. the handle opening is formed with a concave recess to engage the screw shank portion when the screw head is not located within the opening, the screw head being prevented from bi-directionally passing through the opening when the screw shank portion is engaged in the recess; and d. the spring means comprises a leaf spring formed with a generally U-shaped portion adapted to fit over the screw head, the U-shaped portion being located so as to be in a deflected position when the screw head is located within the handle opening and to be in a relaxed position when the screw shank portion is engaged in the opening recess.

3. The tree step of claim 2 wherein:

a. the concave recess is formed in the opening side proximate the handle free end; and b. the leaf spring U-shaped portion comprises an upstanding leg that abuts the screw head to prevent movement of the handle relative to the screw when the screw shank portion is engaged in the opening concave recess.

4. The tree step of claim 1 wherein the handle and arm are pivotable between a first folded side-by-side configuration and a second open configuration in which the handle and arm make an angle of approximately 90°.

5. The tree step of claim 4 wherein:

a. the handle and arm are fabricated as generally U-shaped channels;

b. the channels of the handles and arm form a 4-sided enclosure to enclose the screw when the handle and arm are in the folded configuration; and c. the screw is retained lengthwise within the four-sided enclosure by the spring means.

6. The tree step of claim 2 wherein the handle opening is adapted to receive and engage the screw head when the screw axis is perpendicular to the plane of the handle opening, and when the screw axis is parallel to the plane of the handle opening.

7. The tree step of claim 6 wherein the leaf spring retains the screw against movement relative to the handle under external forces when the screw head is inserted in the opening with the screw axis parallel to the plane of the handle opening and the leaf spring is in the deflected position.

8. The tree step of claim 6 wherein the leaf spring retains the screw against movement relative to the handle under external forces when the screw shank portion is engaged with the opening concave recess and the screw axis is perpendicular to the plane of the opening and the leaf spring is in the relaxed condition.

9. A tree step comprising:

a. an arm;

b. a handle having a first end pivotally connected to the arm and a free end, the free end being formed with a generally rectangular opening therethrough, the rectangular opening being partially defined by a side that further defines a concave recess proximate the free end; and c. a leaf spring having a first end fastened to the handle proximate the handle first end and a second end formed with a generally U-shaped portion that generally coincides with the handle rectangular opening, the leaf spring U-shaped portion being concave on the side facing the handle rectangular opening, the leaf spring being biased into facing contact with the handle, so that the leaf spring can be selectively pulled back from the handle rectangular opening to uncover it and released to recover the rectangular opening.

10. In combination with a tree, apparatus for climbing the tree trunk comprising:

a. a screw for turning into the trunk;

b. a handle having first and second ends, the first end defining an opening therethrough adapted to pass the screw head therethrough, the opening having a side proximate the handle first end that defines a concave recess for engaging the screw shank;

c. an arm connected to the second end of the handle for pivoting between open and closed configurations therewith; and d. spring means fastened to the handle for selectively retaining the handle in place on the screw when the handle opening concave recess is engaged with the screw shank and permitting the handle to be removed from the screw when the concave recess is disengaged from the screw shank.

11. The combination of claim 10 wherein the spring means is a leaf spring attached to the handle near the second end thereof and having a generally U-shaped free end that is adapted to fit over the screw head, the U-shaped free end including an upstanding leg that abuts the screw head to prevent upward movement of the handle relative to the screw when the screw shank is in engagement with the opening concave recess.

12. The combination of claim 10 wherein:

a. the screw is a lag screw; and b. the handle opening has a generally rectangular shape with a size to receive the screw head, so that the handle opening can be placed over the screw head and the handle can be rotated about the screw axis to turn the screw into and out of the tree.

13. The combination of claim 10 wherein the handle and arm are fabricated as U-shaped channels that cooperate to from a 4-sided structure when the arm is pivoted to the closed configuration, and wherein a screw placed within the closed handle and arm is retained within the handle and arm by the spring means, so that the screw may be conveniently carried within the closed handle and arm.

14. A method of aiding a person to climb a tree comprising the steps of:

a. providing a lag screw;

b. providing a handle and an arm pivotally connected to the handle at one end thereof, the handle having an opening therethrough at the handle free end for engaging and passing completely over the lag screw head, the handle defining a concave recess in the opening proximate the handle free end, the handle having a leaf spring attached thereto, the leaf spring having a U-shaped portion adapted to fit over the head of the lag screw;

c. turning the screw into the tree;

d. passing the handle opening completely over the screw head;

e. deflecting the leaf spring with the screw head;

f. pulling the handle downwardly to engage the screw threads with the concave recess;

g. relaxing the leaf spring to capture the screw head with the leaf spring U-shaped portion; and h. opening the arm to a configuration in which it makes approximately a right angle with the handle, so that the handle and arm form a step for supporting a person climbing the tree.

15. The method of claim 14 wherein the step of turning the screw into the tree comprises the steps of:

a. receiving the screw head within the handle opening with the screw axis perpendicular to the plane of the head opening; and b. rotating the handle about the screw axis, so that the handle acts as a lever to aid in turning the screw.

16. The method of claim 14 wherein the step of turning the screw into the tree comprises the steps of:

a. placing the screw with the axis thereof parallel to the plane of the handle opening and with the screw head inserted into the handle opening;

b. pivoting the arm relative to the handle into a closed side-by-side configuration with the screw point extending longitudinally beyond the handle and arm; and c. grasping the closed handle and arm and simultaneously pushing the screw point into the tree and turning the handle and arm about the screw axis to start the screw into the tree.

17. The method of claim 14 wherein:

a. the step of providing a handle and arm comprises the further steps of providing a handle and arm fabricated as U-shaped channels that are pivotable to a closed side-by-side configuration to cooperate to form a 4-sided enclosure; and b. the step of providing a lag screw includes the step of enclosing the lag screw within the closed handle and arm for being retained therein by the leaf spring.

* * * * *